US005729238A

United States Patent [19]

Walton, Jr.

[11] Patent Number: 5,729,238

[45] Date of Patent: Mar. 17, 1998

[54] HOT AIR DE-ICING OF SATELLITE ANTENNA WITH COVER

[76] Inventor: William B. Walton, Jr., 5607 Ave. Juan Bautista, Riverside, Calif. 92509

[21] Appl. No.: 680,777

[22] Filed: Jul. 16, 1996

Related U.S. Application Data

[63] Continuation-in-part of Ser. No. 530,588, Sep. 19, 1995.

[51] Int. Cl.[6] ..... H01Q 1/02

[52] U.S. Cl. ..... 343/704; 392/422

[58] Field of Search ..... 343/704, 872; 392/420, 422, 431, 426; H01Q 1/02

[56] References Cited

U.S. PATENT DOCUMENTS

| | | | |
|---|---|---|---|
| D. 268,343 | 3/1983 | Mann et al. | D14/90 |
| D. 304,454 | 11/1989 | Serres | D14/230 |
| D. 305,334 | 1/1990 | Marr | D14/230 |
| 4,126,864 | 11/1978 | Hopkins | 343/704 |
| 4,213,029 | 7/1980 | Endicott, Jr. et al. | 343/704 |
| 4,259,671 | 3/1981 | Levin | 343/704 |
| 4,368,471 | 1/1983 | Walton, Jr. | 343/704 |
| 4,479,131 | 10/1984 | Rogers et al. | 343/872 |
| 4,536,765 | 8/1985 | Kaminski | 343/704 |
| 4,866,452 | 9/1989 | Barma et al. | 343/704 |
| 4,918,459 | 4/1990 | De Teso | 343/872 |
| 4,955,129 | 9/1990 | McCauley et al. | 29/611 |
| 4,972,197 | 11/1990 | McCauley et al. | 343/704 |
| 5,010,350 | 4/1991 | Lipkin et al. | 343/704 |
| 5,353,037 | 10/1994 | Jones | 343/704 |
| 5,368,924 | 11/1994 | Merrill, Jr. et al. | 428/241 |

FOREIGN PATENT DOCUMENTS

| | | | |
|---|---|---|---|
| 57-65033 | 4/1982 | Japan . | |
| 58-151702 | 9/1983 | Japan . | |
| 59-207701 | 11/1984 | Japan . | |
| 2-34004 | 2/1990 | Japan | H01Q 1/02 |
| 2-109402 | 4/1990 | Japan | H01Q 1/02 |
| 2-109404 | 4/1990 | Japan | H01Q 1/02 |

*Primary Examiner*—Hoanganh T. Le

*Attorney, Agent, or Firm*—Knobbe, Martens, Olson & Bear, LLP

[57] ABSTRACT

A system for preventing the interruption of satellite communications between an earth antenna and a satellite during inclement weather. The system is comprised of a cover, which covers the antenna and substantially prevents the accumulation of snow and precipitation on the antenna, and a heating system which provides heated air to a space between the cover and the antenna to inhibit snow from sticking to the cover and also to inhibit the formation of frozen moisture on the cover during freezing rain and freezing fog conditions. In one embodiment, the system has an electric, gas or oil heater and a blower system which draws air from the space between the cover and the antenna, heats this air and then recirculates the heated air back to the space. Further, the heating system is equipped with a temperature and moisture sensor unit and a controller. The sensor detects the ambient temperature and humidity conditions which are received by the controller to enable heater and blower system to operate within the predetermined temperature and humidity ranges.

19 Claims, 6 Drawing Sheets

HOT AIR DE-ICING OF SATELLITE ANTENNA WITH COVER

RELATED APPLICATIONS

The present application is a continuation-in-part of co-pending application, U.S. Ser. No. 08/530,588 filed Sep. 19, 1995 entitled "HOT AIR DE-ICING OF SATELLITE ANTENNA WITH COVER."

BACKGROUND OF THE INVENTION

1. Field of the Invention

The present invention relates to satellite antennas and, in particular, concerns a system for heating an earth based satellite antenna which includes a cover to be installed on the front face of the antenna and a heater that supplies heat to the cover to prevent accumulations of snow and ice on the cover.

2. Description of the Related Art

Satellite communication systems are becoming increasingly popular in today's world. For example, satellite communication systems are being used by networks of stores for providing inventory information between stores and these systems are also used for credit transactions. In particular, satellite communication systems have increasingly been used by retail stores to approve credit card transactions by individual customers. The primary advantage of satellite communications is that the information can be transmitted to a satellite and then returned to a distant ground station much quicker than the information can be transferred via the telephone lines.

The increasing use of satellite communications has resulted in the installation of many satellite dish antennas in colder climates. One particular problem with positioning satellite dish antennas in colder climates is that snow or freezing rain can accumulate in the dish of the antenna. The accumulations of snow or ice in the dish of the antenna can further result in an interruption of signals between that particular satellite antenna and the satellite. It will be appreciated that satellite networks in colder climates are particularly vulnerable to interruption of the transfer of information on these systems during winter storms and the like.

Several features have been developed in the past to address the problem of accumulations of snow and ice in satellite dish antennas. Satellite antennas have been equipped with fabric covers to prevent snow and ice from accumulating inside of the dish of the antenna. These covers are preferably made of a material that does not interfere with the signals travelling between the satellite and the antenna. One difficulty with these covers, however, is that, while these covers are generally successful in keeping snow and water from accumulating inside of the dish, these covers will quite often be coated by snow or frozen water in certain conditions.

In particular, when there is a wet snow, the wet snow has a tendency to stick to the outside cover of the satellite dish. Similarly, when weather conditions are producing sleet or freezing fog, the frozen ice can also accumulate on the outside cover of the antenna. When either of these conditions occur, communications between the satellite and the earth based antenna can be interrupted.

Another approach taken by satellite antenna manufacturers is to heat the dish antenna so that the surface of the dish antenna is sufficiently warm so as to prevent snow and ice from sticking to the inner surface of the dish antenna. However, it will be appreciated that if the weather conditions are severe enough, the snow and ice will continue to accumulate on the interior of the antenna even though the interior surface of the antenna may be heated above freezing. For example, in a very heavy blizzard the interior surface of the antenna dish may be covered with snow even though the interior surface of the antenna is heated. One such example of a heating system that heats the interior surface of the antenna, and in particular, a plenum chamber positioned adjacent the back side of the antenna, is U.S. Pat. No. 4,368,471 to Walton, Jr.

From the foregoing it is apparent that there is a need for a system that reduces the disruption of communications between satellites and earth based antennas as a result of inclement weather. To this end, there is a need for an improved system of preventing accumulations of snow and ice, and in particular, preventing accumulations of wet snow or ice, from interrupting communications between a satellite and a ground based antenna.

SUMMARY OF THE INVENTION

The aforementioned needs are satisfied by the de-icing system for earth based satellite antennas of the present invention which is comprised of a cover that is configured to cover the front opening of an antenna, a heating system that is configured to heat the cover so that the cover is maintained at a temperature which reduces the accumulation of ice and snow on the cover, a sensor unit to detect atmospheric humidity and temperature conditions, and a controller to receive signals from the sensor and to activate the heating system.

Preferably, the cover is comprised of a flexible material that does not interfere with communication signals between the antenna and the satellite and is also preferably configured to be mounted on the antenna so as to prevent the accumulation of snow and ice on the inner reflecting surfaces of the antenna. Further, the heating system is preferably mounted on the back side of the antenna and provides heated air to the space between the reflecting surfaces of the antenna and the outside cover so as to maintain the cover at a temperature above freezing.

In one preferred embodiment, the heating system includes a blower which blows heated air into the space between the antenna and the cover via an intake tube. Further, there is an exhaust tube that collects air from the space between the antenna and the cover and provides it to the heater. Hence, in this preferred embodiment the heater is a closed-loop heating system that continuously recirculates warm air through the space between the cover and the antenna body. In one particular application, for an antenna having a 1.2 meter diameter, an 800 watt heater with a blower configured to blow air at a rate of 100 CFM is capable of warming the outside cover and maintaining the outside cover at a temperature above freezing. In most weather conditions that would prevent wet snow or freezing fog, that would otherwise stick to the outside cover of the antenna, from sticking.

In one aspect of the present invention the sensor detects the presence of moisture and the ambient temperature of the air surrounding the antenna. The controller is configured to turn on a blower when the presence of moisture is detected. Further, the controller is configured to turn on the heater when the ambient temperature is such that a wet snow would be produced. At other times, only the blower is turned on to produce a positive air pressure inside the space between the cover and the antenna. This reduces the tendency of water to accumulate in the dish of the antenna without incurring the larger operating costs associated with powering the heating element.

For example, snow or moisture at a temperature of less than 24° F. produces a snow which is sufficiently dry that it will not generally stick to the cover of an antenna. Hence, the controller in the preferred embodiment does not turn on the heater when detecting moisture in this temperature range. Similarly, temperatures above 38° F. generally do not produce snow that can stick to the cover. Consequently, the controller in the preferred embodiment does not turn on the heater in this temperature range. Both the blower and the heater are turned on by the controller in the preferred embodiment when moisture is present and the temperature is within a pre-defined range that is likely to result in snow or frozen precipitation sticking to the outside cover of the antenna. If the temperature starts in this range and then drops, the controller preferably leaves the heater on to prevent significant accumulations of snow and ice on the cover of the antenna.

Hence, from the foregoing, the preferred embodiment provides a system which is capable of covering the outside of an antenna so as to prevent the accumulation of snow and ice on the interior surface of the antenna. The system is also capable of warming the cover so as to prevent the accumulation of wet snow, freezing fog, or freezing rain on the outside cover of the antenna and inducing positive pressure to prevent water from entering the space between the cover and the antenna while operating in an efficient energy conserving manner. Further, the system of the preferred embodiment is readily adaptable to existing antennas and does not substantially interfere with communications going to and coming from the antenna. These and other objects and features of the present invention will become more fully apparent from the following description and appended claims taken in conjunction with the accompanying drawings.

DETAILED DESCRIPTION OF THE PREFERRED EMBODIMENT

Figure 1:
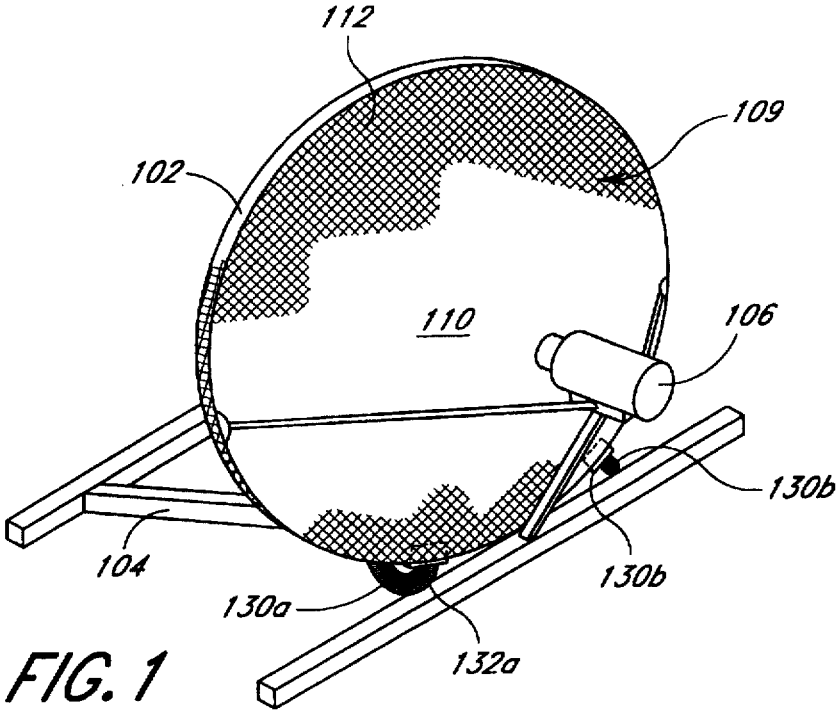
FIG. 1 is a front perspective view of a typical satellite communications antenna equipped with the heating system of the preferred embodiment.

Reference will now be made to the drawings wherein like numerals refer to like parts throughout. Referring now to FIG. 1, an earth satellite antenna 100 is illustrated which is generally comprised of an antenna dish 102 that is mounted on a frame 104 and a collector 106 that is positioned in from of a front side 109 of the antenna dish 102 so as to collect signals reflected from a reflecting surface 110 of the dish 102. In the embodiment shown in FIG. 1, the front side 109 of the antenna dish 102 is generally circular in shape and has a concave configuration. Specifically, the antenna dish 102 is concave so that any signal impinging upon the reflecting surfaces 110 is reflected towards the collector 106.

In the embodiment shown in FIG. 1, a cover 112 is also mounted on the front side 109 of the antenna dish 102. The cover 112 is preferably stretched taut over the concave opening of the antenna dish 102 so as to prevent snow and other precipitation from accumulating on the reflecting surfaces 110 on the inside of the dish 102. In the preferred embodiment, the cover is made of a flexible material, preferably a polyester material or Teflon cloth, such as the cloth sold under the Gortex trademark. It will be appreciated that the cover 112 should preferably be made of some water resistant material that does not inhibit the transmission of satellite communications signals to and from the antenna dish 102.

Figure 2:
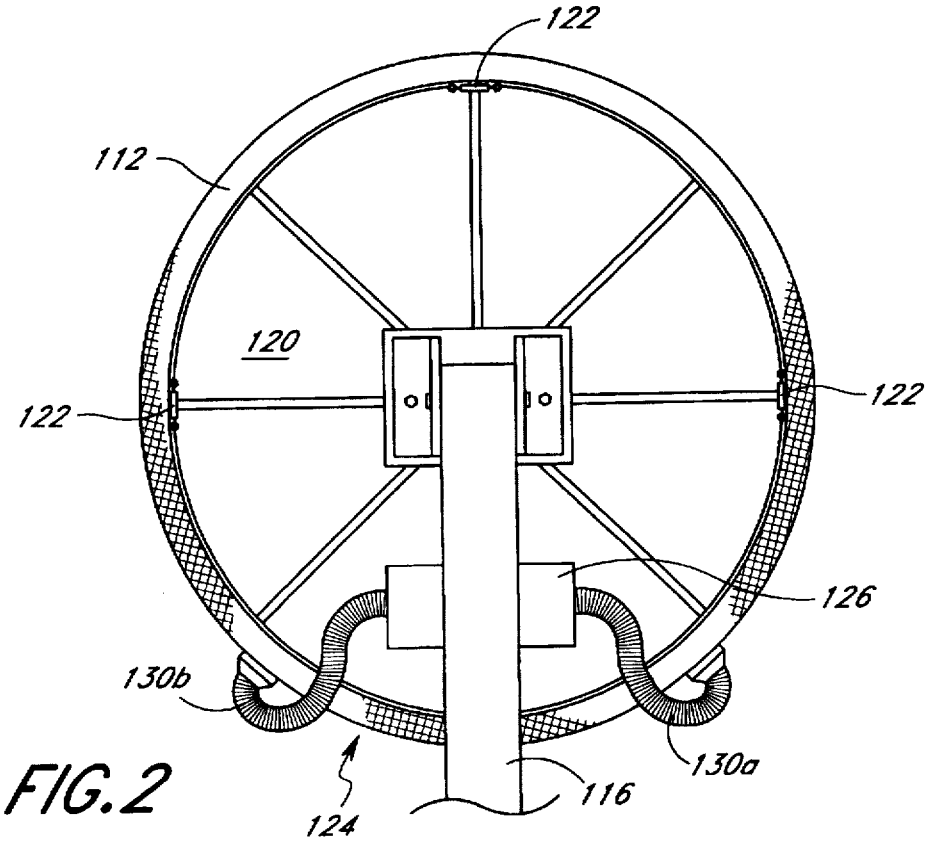
FIG. 2 is a rear perspective view of the antenna shown in FIG. 1 with the heating system of the preferred embodiment installed thereon.

FIG. 2 illustrates a back side 114 of the satellite antenna 100 in greater detail. In particular, the earth satellite antenna 100 is mounted on a vertical support 116 in a well-known manner that permits the antenna dish 102 to be oriented in a desired vertical and horizontal orientation and then fixed in the desired orientation. Further, in this embodiment, the antenna dish 102 is constructed of a number of segments 120 of a desired shape. As is also shown in FIG. 2, the cover 112 is stretched completely over the opening in the front side 109 of the antenna dish 102 and extends onto the back side 114 wherein a spring cable and turnbuckle assembly 122 securely retains the cover 112 on the antenna dish 102 in a well-known manner. It will, however, be appreciated that any number of methods can be used to secure the cover on the antenna dish 102, including positioning elastic material at the outer periphery of the cover 112, that would retain the cover 112 on the antenna dish 102 so as to substantially cover the front side 109 of the antenna dish 102 without departing from the present invention.

It will be appreciated that since the antenna dish 102 in the preferred embodiment is concave, positioning the cover 112 so as to be taut across the front face 109 of the antenna dish 102 results in a space 111 being defined between the reflecting surfaces 110 of the antenna dish 102 and the cover 112. This space is further illustrated in FIGS. 3C and 3D. As will be described in greater detail hereinbelow, the heating system 124 provides heat into the space 111 so as to preferably maintain the cover 112 at a temperature that will prevent snow and ice from forming on the outside surface of the cover and interrupting communications between the antenna assembly 100 and a satellite. It will be appreciated that providing the heat directly into the space 111 results in the antenna dish 102 being heated. This reduces the accumulations of snow and ice on the back side of the antenna dish 102 which thereby reduces the possibility of damage to the antenna dish 102 as a result of the accumulations of snow and ice. Specifically, if too much snow and ice accumulate on the backside of the dish 102, the dish can collapse or "clamshell". Heating the space 111 reduces this possibility as the dish 102 can preferably be heated to a temperature sufficient to prevent excess accumulations of snow and ice on the backside of the dish 102.

FIG. 2 also illustrates that a heating system 124 is mounted on the vertical support 116 of the antenna 100. In particular, the heating system 124 includes an enclosure 126 that contains components of the heating system 124, that will be described in greater detail hereinbelow, and two tubes 130*a* and 130*b* which are respectively a heat inlet tube 130*a* and a heat outlet tube 130*b*. As shown in FIG. 1, the tubes 130*a* and 130*b* are positioned within openings 132*a* and 132*b* respectively in the cover 112 on the front side of the antenna dish 102. As will be described in greater detail hereinbelow, the heating system 124 provides heat to the space 111 between the cover 112 and the reflecting surface 110 of the antenna dish 102 so as to maintain the cover 112 at a temperature sufficient to prevent the accumulation of snow and ice on the cover 112. While in the embodiment shown in FIG. 2 the heating assembly 124, and in particular the heater enclosure 126, is shown as mounted on the vertical support 116 of the antenna 100, it will be appreciated that the heater enclosure can be mounted in any of a number of locations on or adjacent to the antenna 100 without departing from the present invention.

Figure 3A:
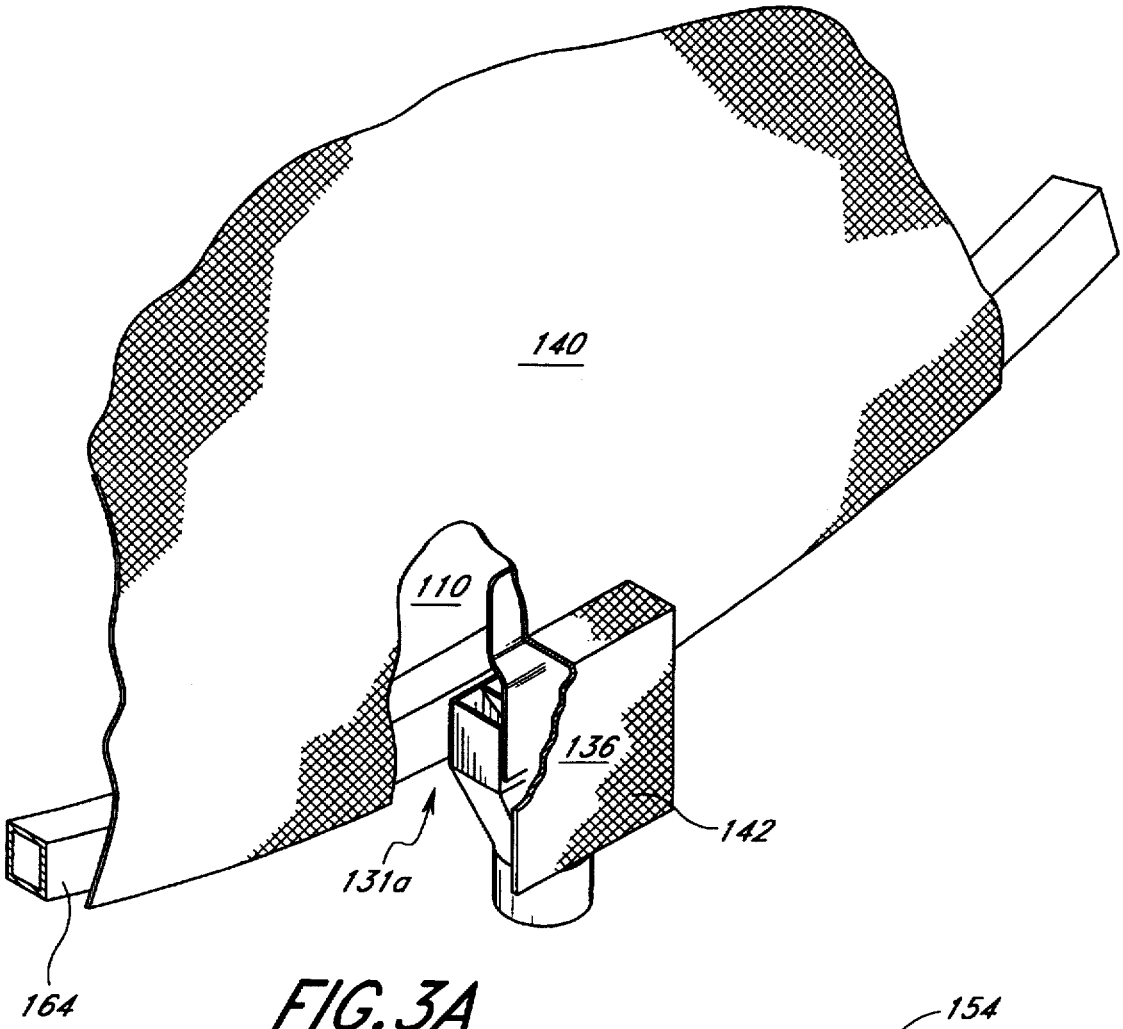
FIG. 3A is a detailed perspective view of an intake fitting which provides heated air to the space between the cover and the antenna.

Referring now to FIG. 3A, the inlet opening 132*a* in the cover 112 is illustrated in greater detail. The following description in reference to FIGS. 3A–3D describes the inlet opening 132*a* and an associated inlet fitting 134*a*, however, the outlet opening 132*b* and an outlet fitting 134*b* are nearly identical in construction. Specifically, in the preferred embodiment the cover 112 is configured to have a generally rectangular pouch 136 that extends outward from a main portion 140 of the cover 112 so as to define the opening 132*a*. The rectangular pouch 136 has a flap 142 that on the underside has an attaching surface such as a hook and loop material. As shown in FIG. 3A, there is an inlet fitting 134*a* that is configured to be connected to the inlet tube 130*a* that is positioned in the pouch 136 so that the inlet fitting 134*a* extends into the opening 132*a* in the cover 112.

Figure 3B:
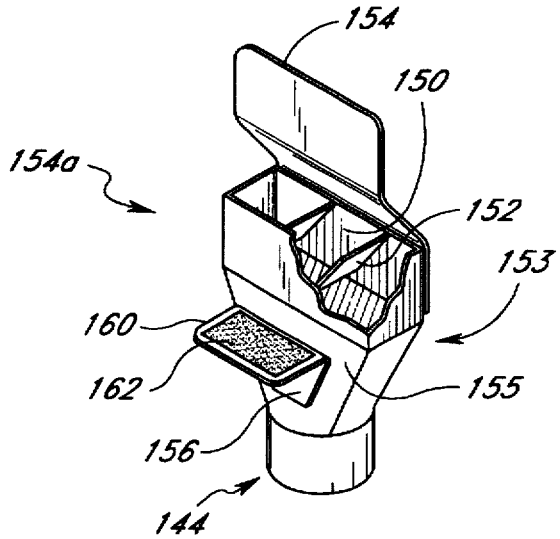
FIG. 3B is a detailed perspective view of the intake fitting shown in FIG. 3A.

The inlet fitting 134*a* is illustrated in greater detail in FIG. 3B. In particular, the inlet fitting 134*a* has a hollow circular section 144 that is open at one end that is configured to receive the inlet tube 130*a* in the manner shown in FIG. 2. Specifically, the inlet tube 130*a* is positioned over the circular section 144 in the inlet fitting 134*a*. The circular section 144 is then connected to a generally rectangular hollow section 146 that has a rectangular opening 150 at the end opposite the circular section 144. The rectangular section 146 has two directing vanes 152 adjacent the opening 150 that direct heat, emanating from the inlet fitting 144, in a generally clockwise direction in the space 111 in the manner that will be described hereinbelow in conjunction with FIG. 5. Further, there is a flange 154 positioned on a top side 153 of the inlet fitting 134*a* that is configured to ensure that the cover 112 is not blocking the rectangular opening 150 and preventing heat from passing from the inlet fitting 134 into the space 111.

Figure 3C:
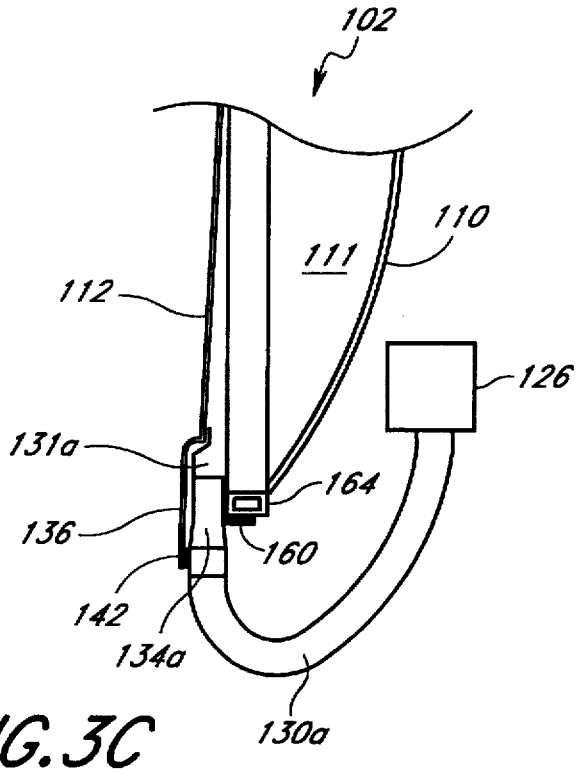
FIG. 3C is a sectional view of the cover and the satellite antenna having the system of FIG. 1 installed thereon further illustrating the mounting of the intake fitting and the cover.

Further, as illustrated in FIG. 3B, on a bottom side 155 of the inlet fitting 134*a* there is a mounting flange 156 positioned thereon. The mounting flange 156 is a generally L-shaped piece of material having a mounting plate 160 that extends in a direction generally perpendicular to the bottom side 155 of the inlet fitting 134*a*. Preferably, the mounting plate 160 has a piece of hook and loop material 162, e.g., Velcro material, positioned thereon. As illustrated in FIG. 3C, the mounting plate 160 is positioned adjacent an outer rim 164 of the antenna dish 102 when the inlet fitting 134*a* is positioned in the opening 130*a*. Preferably, a matching piece of hook and loop material is positioned on an outer rim 164 of the antenna dish 102 so that the material 161 on the mounting plate 160 engages with the material on the outer rim 164 of the antenna dish 102 to securely maintain the inlet fitting 134 in the opening 130 in the cover 112.

Further, as is also shown in FIG. 3C, hook and loop material is also mounted on the underside of the flap 142 of the pouch 132*a* and on the top surface 153 of the fitting so that the flap 142 is securely attached to the upper surface 153 of the fitting 134*a* to further maintain the fitting 134*a* in the desired orientation shown in FIG. 3A. Hence, the fitting is positioned within the pouch 132*a* so that the rectangular opening 150 allows for air to be introduced through the opening 130*a* in the cover 112 and the fitting 134*a* is retained in this position by the detachable engagement between the hook and loop material on the mounting plate 160 and the upper surface 153 of the fitting 134*a*. It will be appreciated, however, that alternative forms of securing the fitting 134*a* to the rim 164 of the antenna dish 102 and to the flap 142 of the pouch 136 can be used without departing from the present invention. For example, snaps, glue and other types of securing means can be used.

Figure 3D:
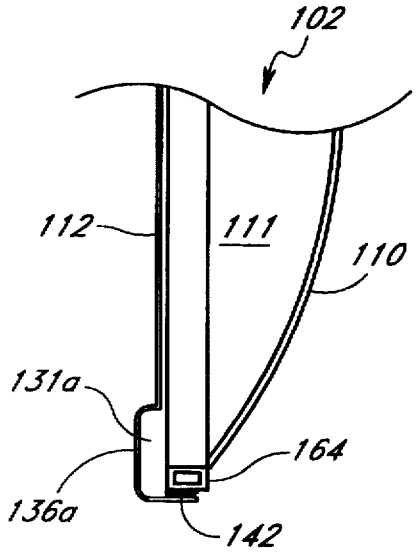
FIG. 3D is a sectional view of the cover and the satellite antenna of FIG. 3C, wherein the intake fitting has been removed and the cover has been secured to the antenna frame.

FIG. 3D illustrates that the cover 112 is configured so that when the heating system 124 of the present invention is not being used, the bottom side of the flap 142 can engage with the rim of the antenna 164 to close the cover 112 about the antenna dish 102. Hence, the cover 112 can be used in conjunction with the heating system 124 for dynamically heating the space 111 between the cover 112 and the reflecting surface 110 of the antenna dish 102 or the cover 112 can be installed on the antenna dish 102 to passively prevent the accumulation of snow and ice and other moisture on the concave reflecting surfaces 110 of the antenna dish 102.

Figure 4:
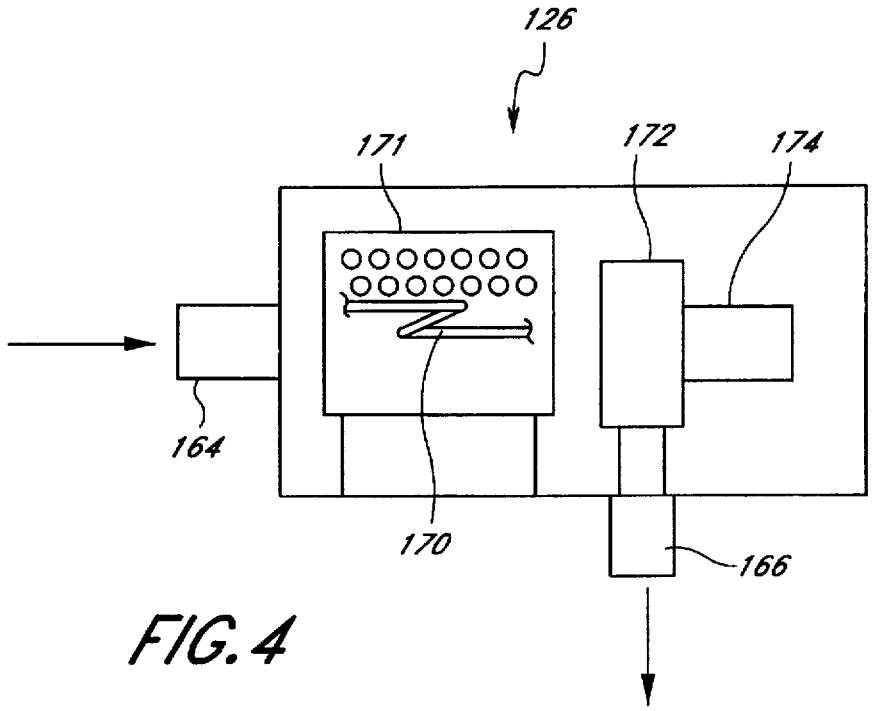
FIG. 4 is a detail of the heater/blower assembly which is a component of the heating system of the preferred embodiment.

FIG. 4 schematically illustrates the heater enclosure 126 which forms a portion of the heating system 124. The heater enclosure 126 is preferably a rectangular box that has a heating element 170 and a blower 172 with an associated blower motor 174 positioned therein. The heating element 170 is positioned within the heater enclosure 126 so that an air intake opening 164 in the enclosure provides air directly to the heating element 170. As shown in FIG. 4, the heating element 170 is positioned so as to located inside of a stainless steel shroud 171 that provides a channel for the air produced by the blower 172 to thereby improve the heating efficiency of the heating element 170. Further, the blower 172 is configured to draw air from the intake opening 164 in the enclosure 126, through the coils of the heating element 170 and then exhaust the air through an enclosure exhaust opening 166.

Preferably, the intake opening 164 of the enclosure is connected to the outlet tube 130*b* (FIG. 1) whereby air from the space 111 between the cover 112 and the concave surface 110 of the antenna is provided to the heating element 170 and is reheated. Similarly, the exhaust opening 166 in the heater enclosure 126 is connected to the inlet tube 130*a* (FIG. 1) that provides the heated air from the heater enclosure 126 to the space between the cover 112 and the concave surface 110 of the antenna dish 102.

Hence, in the preferred embodiment, the blower 172 draws air out of the space 111 through the tube 130*b* and then through the heating element 170 to reheat this air. Subsequently, the blower 172 then exhausts this heated air out through the exhaust opening 166 through the tube 130*a* and the tube 134*a* back into the space 111 between the cover 112 and the concave surface 110 of the antenna dish 102. Consequently, a closed loop heating circuit is established whereby heated air is recirculated through the space 111 between the cover and the antenna dish.

Preferably, the blower 172 and the heating element 170 is configured to provide sufficient heated air to the space 111 so that the cover 112 is maintained at a temperature which inhibits wet snow from sticking to the cover 112 and further inhibits formation of ice particles on the cover 112 as a result of freezing rain and freezing fog and inhibit ice and snow build-up on the antenna dish 102. In one embodiment, for a 1.2 meter satellite dish, the heating element is an 800 Watt electrical heating element that is bent in a generally helixical fashion. The heating element is available from Chromolux and is mounted within the enclosure 126 so that the center axis of the heating element is positioned substantially in front of the intake opening 164 so that air is drawn through the center of the helixical heating element. Further, the blower is a 100 CFM blower that uses a 1/70th horsepower motor to draw the air from the space through the heating element 170 and then back to the space. It will be appreciated that the enclosure 126 also includes the requisite protection and control circuitry used to control and protect the heating element and the motor during operation.

It will further be appreciated that many types of heaters and heating systems and blower and blower systems can be used to provide heat to the space between the cover 112 and the concave surface 110 of the antenna dish 102. For example, for larger antennas it may be desirable to use a gas heating system such as the gas heating system that is currently available from WB Walton Enterprises, Inc. of Riverside, Calif. Further, the exact heat output of the heater and the air transfer capability of the blower is, of course, dependent upon the size of the antenna dish and is also dependent upon the temperatures to which the antenna dish is likely to be exposed. It will further be appreciated that the enclosure 126 can be equipped with a sensing system, such as the sensing systems currently available from WB Walton Enterprises, Inc., that will turn the heating system 124 on during particular weather conditions. For example, the sensing system may include a sensor which detects when the air temperature is low enough for snow and ice to form and then automatically activate the heating system 124 to provide heated air to the space 111. One preferred embodiment of a sensing system is described in greater detail below in reference to FIGS. 6, 7A and 7B.

Figure 5:
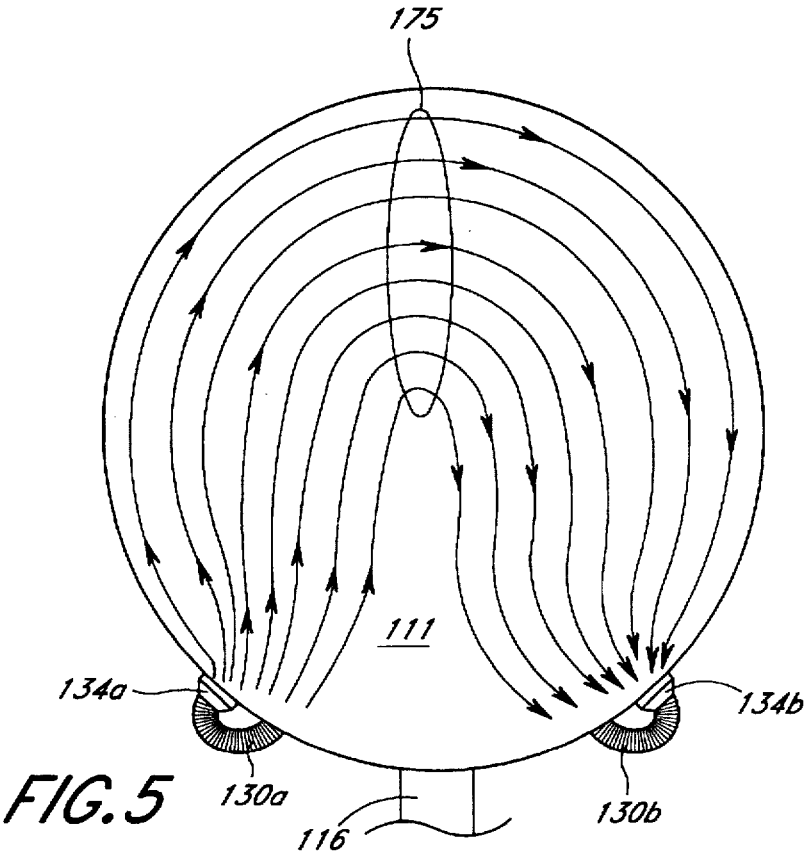
FIG. 5 is a schematic view of the satellite antenna illustrating the airflow in the space between the antenna dish and the cover.

FIG. 5 is a schematic illustration which illustrates how the heated air provided by the heating system 124 is circulated through the space between the cover 112 and the concave surface 110 of the antenna dish 102. Specifically, the vanes 152 on the inlet fixture 134*a* (FIGS. 3A, 3B) in this embodiment induce the heated air to travel around the space 111 in a generally clockwise fashion as illustrated by the arrows 175. In the preferred embodiment, the outlet fitting 134*b* is larger than the inlet fitting 134*a* so that the air flow 175 through the space 111 is not short circuited. For example, in one specific implementation, for an antenna that is 1.2 m in diameter or smaller, the inlet fitting 134*a* has an opening which is 2"×4" and the outlet fitting 134*b* has an opening that is 2"×5". Using a larger return air duct allows the inlet air to be forced to the top of the plenum or space 111 and thereby fully circulate through the space 111. This further contributes to the circulation of the heated air through the space 111 in the clockwise manner shown. It will be appreciated that this circulation of heated air underneath the cover 112 maintains the cover 112 at a temperature which inhibits the formation of snow and ice on the cover and thereby inhibits the interruption of communication signals to and from the satellite dish antenna 100 during inclement weather.

Figure 6:
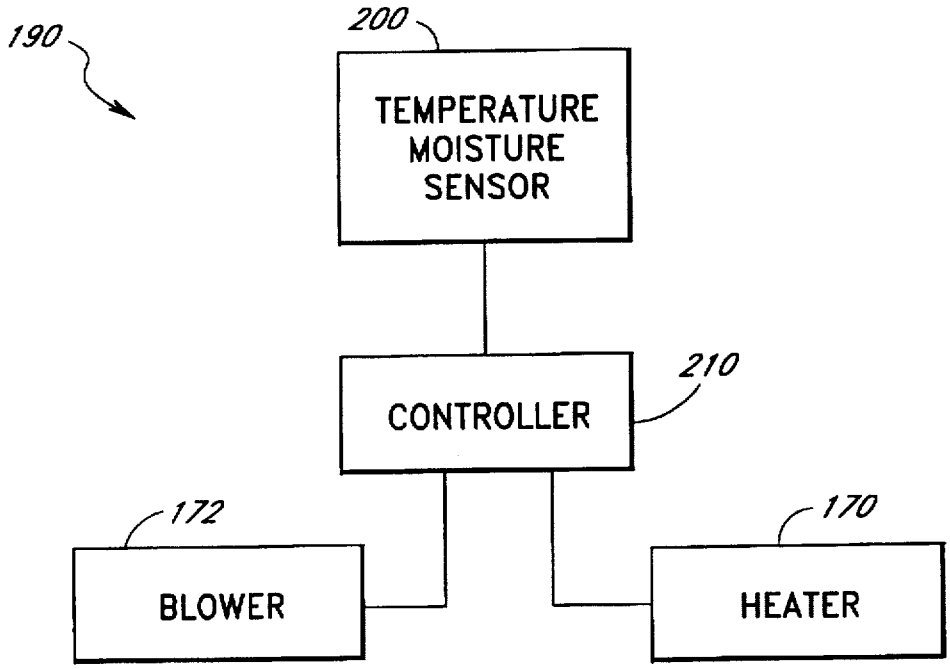
FIG. 6 is an exemplary block diagram showing a layout for a sensor controlled heater and blower system.
Figure 7A:
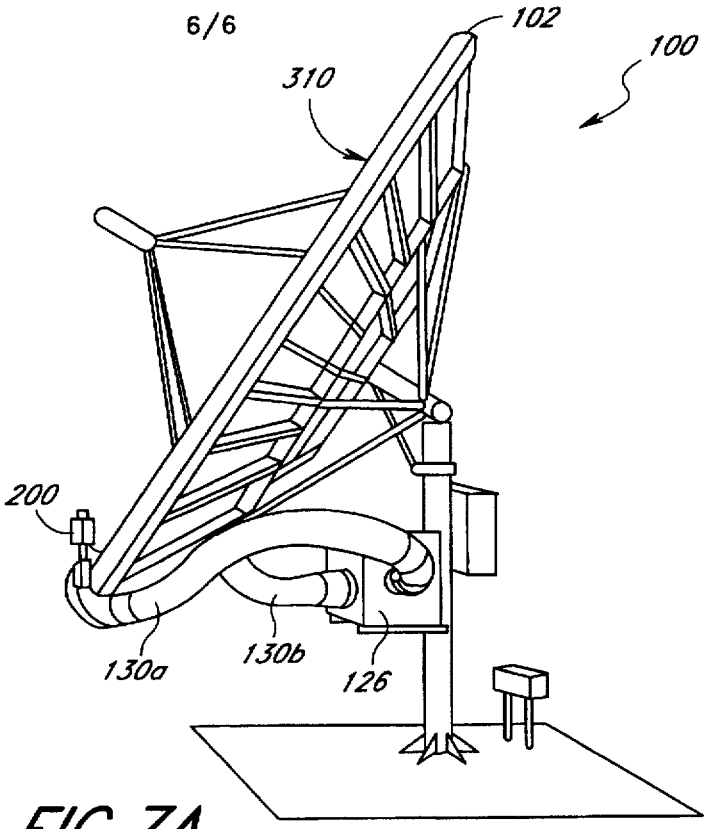
FIG. 7A is a side view of the satellite antenna showing a flat antenna cover occurring in absence of a positive air pressure in the space between the antenna dish and the cover.
Figure 7B:
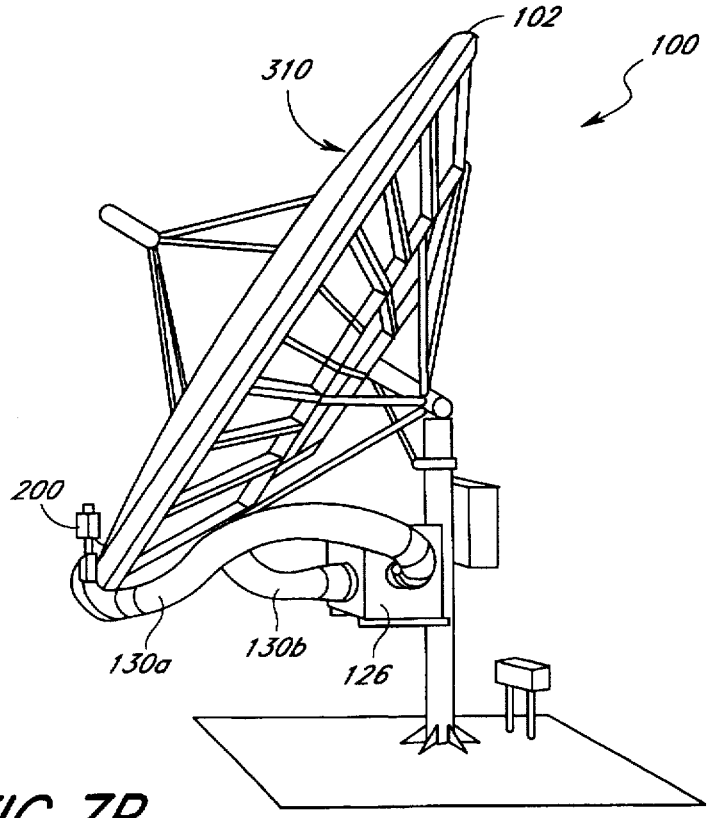
FIG. 7B is a side view of the satellite antenna shown in FIG. 7A, wherein a positive air pressure is applied and the cover is bulged out.

FIGS. 6, 7A and 7B illustrate a control system that can be used with the preferred embodiment of the present invention. Specifically, the heating enclosure 126 is equipped with a temperature/moisture sensor and control unit 190 which turns the heater 170 system on during particular weather conditions. In particular, the sensor and control unit 190 includes a sensor 200, such as a DS-3 moisture/temperature sensor unit available from Automatic System Engineering Inc., of Colorado Springs, Colo. The sensor unit 200 senses both temperature and the presence or absence of moisture and provides signals indicative thereof to a controller 210.

In order to sense atmospheric temperature and moisture conditions, at least one sensor unit 200 is mounted on an edge of the antenna dish 102 ( See FIG. 7A or 7B). Preferably, the sensor 200 is mounted in a location that is removed from the heater enclosure 126 so that the sensor 200 can sense the ambient conditions unaffected by the operation of the heater and blower.

Hence, the sensor unit 200 senses the ambient temperature and moisture conditions, and provides signals to a controller 210 that energizes the heater 170 and blower 172 systems (FIG. 5) in response to the sensed atmospheric conditions. Specifically, the controller 210 selectively turns on the heater 170 and blower 172 systems in response to sensing temperature and humidity within preselected ranges. In this embodiment, the controller 210 turns the blower 172 on when the sensor 200 detects the presence of moisture. In the preferred embodiment, the sensor 200 has a cup that receives moisture and when moisture is present in the cup, the sensor 200 provides a moisture present signal. It will be appreciated by those skilled in the art, that a humidity sensor may also be adapted for use in the system of the preferred embodiment. The controller 210 turns on the heater 170 when the sensor detects the presence of moisture and detects that the temperature is in a temperature range of between 24° F. and 38° F. This is due to a known phenomenon that snow is relatively dry under 24° F., and contrarily is relatively wet over this temperature.

More specifically, in the preferred embodiment, when moisture is present and the ambient temperature is between 24° F. and an upper temperature limit that is selected by the operator in the preferred embodiment, but is preferably around 38° F., the heater 170 and the blower 172 are activated together so that hot air is circulated in the space 111 to de-ice wet snow in the manner described above. Further, the heater 170 and the blower 172 continue to operate as the temperature drops below 24° F., thereby allowing de-icing to continue. However, if moisture is first sensed in the preselected quantity when the temperature is equal or below 24° F., the heater 170 and the blower 172 are not activated by the presence of moisture unless the temperature increases above 24° F. Since snow at this temperature range is very dry, it will not cause any icing problem over the antenna cover.

Finally, when moisture is sensed but the temperature is above the upper limit, the blower 172 is activated to induce a positive air pressure in the space 111. In fact, the blower 172 in larger antennas can activate anytime when moisture is detected in sufficient quantity, regardless of the temperature range. The air entering the space 111 between the dish 110 and cover 112 creates a positive pressure 320 under the cover 112 causing the cover 112 to bulge out as shown in FIG. 7B.

Specifically, FIG. 7A shows a profile of the antenna assembly 100 with no positive pressure under the cover 112 and the cover surface 310 is flat, i.e., flush with the rim of the antenna dish 110. In FIG. 7B, however, the cover surface 310 has a convex shape with respect to the antenna dish 110 due to positive air pressure that has been introduced into the space 111 as a result of the blower 172 operating. This positive air pressure is advantageously used to reduce or prevent moisture from entering the enclosed space 111 between the dish surface and the cover. Additionally, the convex surface aids in the shedding of snow and rain on the outside surface of the cover 112 and thereby accumulations of frozen precipitation on the cover which may degrade the operation of the antenna.

Hence, the control system 190 senses the ambient temperature and presence or absence of moisture of the environment surrounding the antenna. The control system 190 can then selectively activate the blower 172 or the heater 170 or both depending upon the ambient conditions. It will be appreciated that control system 190 of the preferred embodiment is efficient in preventing accumulations of frozen precipitation on the cover of the antenna as it operates the heater 170 only when the temperature is in a range where wet snow, frozen rain or frozen fog could occur. At other temperature ranges, the moisture that is present is either too dry, e.g., the temperature is below 24° F., to stick to the cover or the moisture that is present would not produce frozen precipitation as the temperature is too high e.g., the temperature is above 38° F. In these conditions, only the blower 172 is operated to induce a positive air pressure and prevent accumulations of moisture inside the space 111 between the cover 112 and the antenna 110 and to aid in the shedding of dry snow off of the front surface of the cover.

Although the foregoing description of the preferred embodiment of the present invention has shown, described, and pointed out the fundamental novel features of the invention, it will be understood that various omissions, substitutions, and changes in the form of the detail of the apparatus as illustrated, as well as the uses thereof, may be made by those skilled in the art without departing from the spirit of the present invention.

What is claimed is:

1. A system for reducing accumulations of moisture on a front reflecting surface of a satellite antenna having an outer lip comprising:

a flexible cover having an opening which is dimensioned to mount on said outer lip of said antenna with the cover positioned over said front reflecting surface of said satellite antenna so as to define a space between said front reflecting surface of said antenna and said cover whereby said cover reduces accumulations of frozen precipitation on said front reflecting surface of said satellite antenna while permitting satellite signals to pass therethrough;

an air supply system which provides unheated air to said space between said cover and said front reflecting surface so as to induce positive pressure in said space with respect to said surrounding atmosphere so as to reduce the accumulation of moisture within said space;

a heating system that provides heat to said space between said front surface of said antenna and said cover so as to maintain said cover at a temperature sufficient to reduce accumulations of frozen precipitation on said cover;

a sensing system which senses the temperature and the presence of moisture of the atmosphere surrounding said satellite antenna; and a controller which receives signals from said sensing system wherein said controller activates said air supply system upon said sensing system detecting the presence of a preselected quantity of moisture and wherein said controller activates said heating system upon detecting that said temperature of said atmosphere surrounding said satellite antenna is in a predetermined range of temperatures.

2. The system of claim 1, wherein said controller initiates said heating system upon said sensing system detecting that the temperature of atmosphere surrounding said satellite antenna is within said predetermined temperature range and wherein said predetermined temperature range has been selected to define a range wherein frozen precipitation will adhere to said cover.

3. The system of claim 2, wherein said predetermined temperature range is approximately 24°–38° F.

4. The system of claim 1, wherein said controller activates said air supply system upon detecting the presence of moisture in said preselected quantity so that a positive air pressure is induced in said space between said cover and said front reflecting surface of said antenna so as to reduce the likelihood of moisture entering said space.

5. The system of claim 4, wherein said cover is flexible and, when said air supply system is activated, said cover has a convex shape with respect to the outer surface of said front reflecting surface of said antenna and wherein said convex shape of said cover aids in the shedding of frozen precipitation from said cover.

6. The system of claim 1, wherein said heater system is activated only when both said sensing system detects the presence of moisture and also detects that the temperature of the atmosphere is within said predetermined temperature range at the time the presence of moisture is detected.

7. The system of claim 6, wherein said controller continues to induce said heating system to supply heat to said space when the temperature of the atmosphere drops from the temperature at the time moisture was detected to a temperature below said predetermined range.

8. A system for reducing accumulation of moisture on a front reflecting surface of a satellite antenna having an outer lip comprising:

a flexible cover having an opening which is dimensioned to mount on said outer lip of said antenna with the cover positioned over said front reflecting surface of said satellite antenna so as to define a space between said front reflecting surface of said antenna and said cover whereby said cover reduces accumulations of frozen precipitation on said front reflecting surface of said satellite antenna while permitting satellite signals to pass therethrough;

an air supply system which provides unheated air to said space between said cover and said from reflecting surface so as to induce positive pressure in said space with respect to said surrounding atmosphere so as to reduce accumulations of moisture in said space and so that said flexible cover deforms outward from the lip of the antenna so as to form a convex shape which facilitates in the shedding of moisture from said cover;

a heating system that provides heat to said space between said front surface of said antenna and said cover so as to maintain said cover at a temperature sufficient to reduce accumulations of frozen precipitation on said cover;

a sensing system which senses the temperature and the presence of moisture of the atmosphere surrounding said satellite antenna;

a controller which receives signals from said sensing system wherein said controller activates said air supply system upon said sensing system detecting the presence of moisture and wherein said controller activates said heating system upon detecting both the presence of moisture and that the temperature of the atmosphere surrounding said satellite antenna is in a predetermined range of temperatures at the time moisture was detected.

9. The system of claim 8, wherein said controller activates said heating system upon said sensing system detecting that the temperature of the atmosphere surrounding said satellite antenna with said predetermined range wherein said predetermined temperature range has been selected so as to define said range wherein frozen precipitation adheres to said cover.

10. The system of claim 9, wherein said predetermined temperature range is approximately 24°–38° F.

11. The system of claim 8, wherein said controller activates said air supply system upon detecting the presence of moisture so that a positive air pressure is induced in said space between said cover and said front reflecting surface of said antenna so as to reduce the likelihood of moisture entering said space.

12. The system of claim 11, wherein said cover is flexible and when said air supply system is activated, said cover has a convex shape with respect to the outer surface of said front reflecting surface of said antenna and wherein said convex shape of said cover aids in the shedding of frozen precipitation from said cover.

13. A method of preventing frozen precipitation from interrupting communications with a ground based satellite antenna comprising the steps of:

positioning a flexible cover on a lip of the antenna on a front concave side of said satellite antenna so as to define an enclosed space between said cover and a front reflecting surface of said antenna so as to reduce accumulations of frozen precipitation on said concave surface of said antenna while permitting satellite signals to pass therethrough;

sensing the presence or absence of moisture in the atmosphere surrounding said satellite antenna;

sensing the temperature of the atmosphere surrounding said satellite antenna;

supplying unheated air to said space between said cover and said front reflecting surface of said antenna so as to induce a positive air pressure within said space with respect to said atmosphere upon detecting the presence of a predetermined quantity of moisture in said atmosphere; and supplying heat to said space between said cover and said front reflecting surface upon detecting that the temperature of said atmosphere is within a predetermined temperature range.

14. The method of claim 13, wherein heat is supplied when said temperature of said atmosphere is within a predetermined range of temperatures wherein frozen precipitation is likely to adhere to said cover.

15. The method of claim 13, wherein air is supplied to said space when moisture in said atmosphere is sensed in a quantity wherein precipitation is likely to be deposited on said cover.

16. The method of claim 14, wherein heat is supplied when said temperature of said atmosphere is in the approximate range of 24°–38° F.

17. The method of claim 13, wherein heat is supplied to said space only upon detecting that both said temperature of said atmosphere is within said range and also that a predetermined quantity is moisture is present within said atmosphere.

18. The method of claim 17, further comprising the steps of:

continuing to sense the presence and absence of moisture while said air supply system is operating; and disabling said air supply system when said predetermined quantity of moisture is no longer present in said atmosphere.

19. The method of claim 18, further comprising the steps of:

continuing to sense the temperature of said atmosphere while said heating system is operating;

disabling said heating system when said temperature of said atmosphere increases to above said predetermined range; and continuing to operate said heating system when said temperature falls below said range when moisture is present in said atmosphere in said predetermined quantity.

* * * * *

UNITED STATES PATENT AND TRADEMARK OFFICE

CERTIFICATE OF CORRECTION

PATENT NO. : 5,729,238

DATED : March 17, 1998

INVENTOR(S) : William B. Walton, Jr.

It is certified that error appears in the above-identified patent and that said Letters Patent is hereby corrected as shown below:

Column 4, Line 12, please change "in from" to --in front--.

Column 10, Line 56, please change "said from" to --said front--.

Signed and Sealed this

Tenth Day of November 1998

*Attest:*

*Attesting Officer*

BRUCE LEHMAN

*Commissioner of Patents and Trademarks*